United States Patent [19]

Bruner et al.

[11] Patent Number: 4,636,428

[45] Date of Patent: Jan. 13, 1987

[54] WEFT INSERTED WARP KNIT FENCING PRODUCT

[75] Inventors: Jeffrey W. Bruner, Greensboro; Delbert A. Davis, Kernersville, both of N.C.

[73] Assignee: Burlington Industries, Inc., Greensboro, N.C.

[21] Appl. No.: 854,606

[22] Filed: Apr. 22, 1986

[51] Int. Cl.[4] ..... B32B 7/00

[52] U.S. Cl. ..... 428/254; 428/253

[58] Field of Search ..... 428/253, 254, 263

[56] References Cited

U.S. PATENT DOCUMENTS 4,233,358 11/1980 Jones et al. ..... 428/254
4,350,725 9/1982 Pflüger ..... 428/254
4,425,398 1/1984 Berczi ..... 428/254
4,434,200 2/1984 Fash et al. ..... 428/257
4,535,015 8/1985 Bruner et al. ..... 428/53

*Primary Examiner*—James J. Bell
*Attorney, Agent, or Firm*—Nixon & Vanderhye

[57] ABSTRACT

Weather-resistant fencing products knitted from yarns of synthetic fibers into an open pattern in which from 40 to 80% of the fabric surface is open to the passage of air and particulates. The closed portion resists air and particulates passage causing particulates to be deposited on both the windward and leeward side of the fence. Selection of fence height and degree of openess controls the height and length of the mass of particles accumulated adjacent to the fence. The knit fabric construction is useful as a snow fence.

7 Claims, 6 Drawing Figures

WEFT INSERTED WARP KNIT FENCING PRODUCT

BACKGROUND OF THE INVENTION

1. Field of the Invention

This invention relates to a knit fencing product finished with a polymeric coating that renders the fabric resistant to abrasion and ultraviolet light.

2. Summary of Prior Procedures

Fencing products made from fibrous materials, such as nylon, polyester, cotton, and the like, have been used for several years. They are used for crowd control, to control the drift or spreading of particular sand erosion, and as snow fencing materials to control the drifting of snow.

Illustrative of commercially available products is U.S. Pat. No. 4,434,200 to Fash and Davis describing a woven fencing product that is flexible at normal temperatures, stable at cool temperatures and woven in an open weave pattern from nylon, polyester or the like. The woven product is then impregnated with an elastomeric polymer coating which provides ultraviolet light protection and resistance to abrasion. In particular this impregnated woven product is used as a snow fencing. Also illustrative is U.S. Pat. No. 3,672,638 to Krebs that describes a snow fence made of a woven wire fabric in which the warp wires extend parallel to the ground while the weft wires extend perpendicular to the ground.

Both of these designs allow a certain amount of wind flow and passage through the fence while providing a sufficient degree of resistance to wind passage to allow for collection of particulate materials. With reference to U.S. Pat. No. 4,434,200, the weave pattern is designed to cover itself with airborne particulate snow or soil that leaves downwind or leeward drifts in lengths of approximately 16 to 20 times the height of the fence itself with a windward drift of about 7 to 9 times the height of the fence.

We have now discovered that a more porous or open fence configuration that allows drifts or dunes to build on the leeward side of the fence to lengths of about 30 times the height of the fence of the windward portion increases the dune or drift configurations to a factor of 12 times the height. This allows the fence to be more active for longer periods of time. We have also discovered, and hereby disclose, a procedure for knitting a fencing product that is readily adapted to manufacturing variations so that a fencing product can be produced in various configurations that will allow from about 40 to up to about 80% of the fabric's surface to be open for particulate redistribution. This permits tailoring of the fencing product to a particular location, an optimum design for particulate matter to be controlled or other application, and allows the supplier of the fencing product to offer a range of products for various applications and uses.

One of the objects of the present invention then is to provide a knitted fencing product that is easily variable in structure such that between 40 and 80% of the fabric's surface is open for particulate redistribution. This permits the customer to choose the optimum pattern for a particular application based upon the widely varying climate and wind conditions found throughout the world.

In particular applications, we envision the use of this knitted fencing product to control soil erosion in soil conservation areas where the build-up of particulate from fences can be gathered and redeposited in areas of need. In like manner, in snow areas, drifts can be situated in specific positions so in the winter to form frozen reservoirs that later, when warmer weather arrives, will melt and provide water in a predetermined area.

SUMMARY OF THE INVENTION

The present invention provides for a lightweight easily handled fencing product which is capable of withstanding sustained periods of direct sunlight and/or cold temperatures without adversely affecting the properties thereof. In accordance with the present invention knitted fabric is formed having a plurality of open spaces therein from a tough elastic, synthetic plastic material such as an acrylic polymer, polypropylene nylon or polyester to which an elastomeric composition containing one or more ultraviolet sun screens has been applied. The elastomeric finish provides the fence with stability at low temperatures, i.e., −10° to 30° F., abrasion resistance to fine particulate matter such as sand and resistance to oxidation and sunlight degradation caused by ultraviolet light rays.

Other features and advantages of this invention will become apparent in the more detailed description which follows, and in that description reference will be made to the accompanying drawings as briefly described below.

A weft inserted warp knit fencing structure finished with polymeric coating lending abrasion resistance and/or ultraviolet light degradation resistance to the product is described. The fencing product is flexible at normal temperatures and stable at cool temperatures. From 40 to 80% of the surface of the knit fencing product is open and reinforced selvedges are provided at one or both ends or optionally in intermediate areas of the fence to allow for fastening or hanging of the fence to a suitable support.

It is contemplated that the fencing product of the present invention be used in any number of the following illustrative embodiments: as a yard fencing; as a decorative screen around the home, or as a wind screen or at the beach to prevent the erosion of sand; to serve as guide markers on ski trails; to direct ski traffic; to provide crowd control at sporting events such as golf matches, ski meets and the like; as a guide to audiences to direct them to their proper places through the use of an appropriate color; and as decorative and protective screening around trailer courts, camps, patios and backyards, outdoor swimming pools and the like.

The fencing product with an elastomeric composition containing a pigment or mixture of pigments. It is also possible to treat the fencing product so that it conducts electricity by incorporating one or more electroconductive materials in the elastomeric polymer composition before it is applied to the knitted material.

The knitted fencing product in accordance with the present invention is prepared by a weft inserted warp knit technique. Warp knitted weft inserted fabrics offer a number of unique advantages over the conventional woven snow fence and blown particulate fences for at least the following reasons:

(1) Weft inserted warp knits (WIWK) by their nature are adapted to be adjusted to vary the open area of the fencing product with great ease by partially threading the warp and weft yarns as illustrated in the attached drawings. For specific applications, the amount of open area, expressed as a percentage, can be adjusted from 40–80% to optimize the dune/drift configurations.

(2) Also improved are the reinforced selvedges which aid in finishing the fabric and also act as integral reinforced fastening areas when hanging the fences in the field. These selvedges may also contain non-woven fibrous strips for additional reinforcement, similar to those described in U.S. Pat. No. 4,535,015, the disclosure of which is hereby incorporated by reference.

(3) Dummy or pseudo selvedges are optionally incorporated into wide width panels for additional reinforcement to aid hanging and also allow wide panels to be slit into two or more narrower panels, i.e., 80" wide panel slit to 2×40" panels, 120" wide panel slit to 3×40" panels, or (1×40")+(1×80") panels.

Knit Design: Weft inserted fabrics produced on conventional parallel and crossing type weft insertion machines, such as those produced by Liba, Mayer, Malimo and Barfuss, can all deliver a suitable fabric to meet the end use requirements outlined above.

The fabric width necessary will vary depending upon the particular use but will usually be in the range from 1 meter to 5 meters wide as produced on the knitting equipment. After finishing, fabrics are preferably hung in the field such that the machine direction runs parallel to the terrain. The filling yarns are selectively placed in a repeating arrangement such that they are grouped together to simulate a conventional wood slat. A predetermined space is left to allow the air to pass through.

The warp yarn repeat shall be such that the apparent machine direction reinforcement shall average between 3 and 20 per inch.

Figure 1:
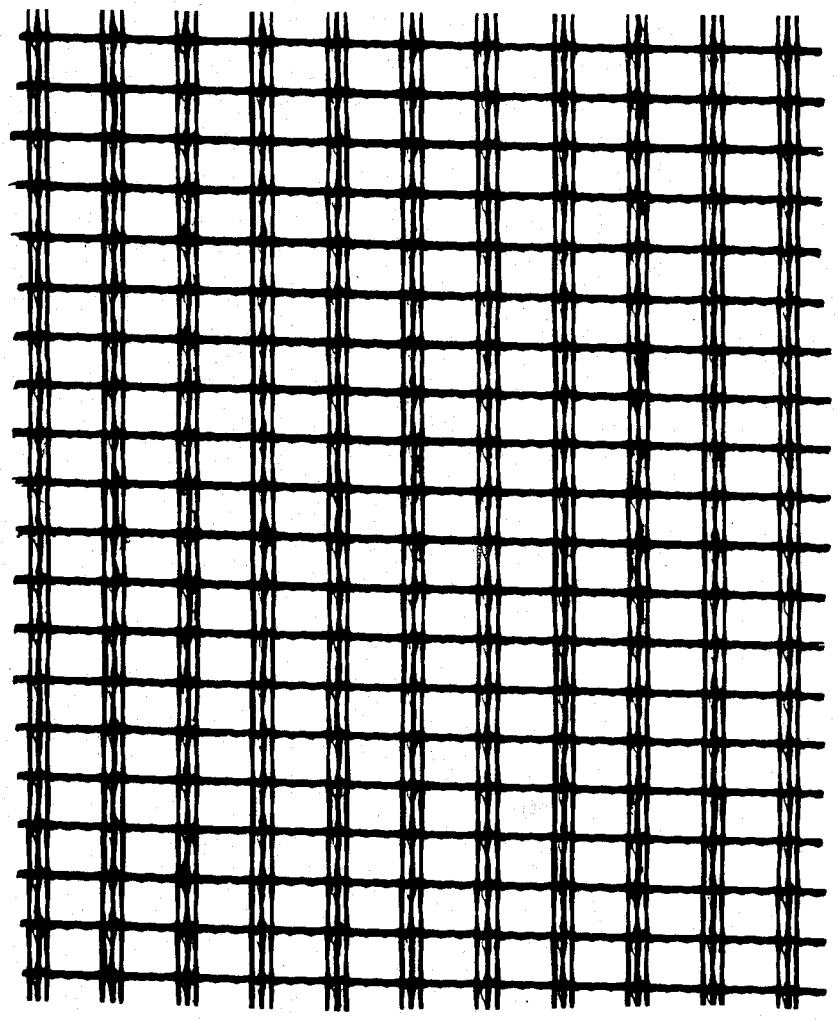
FIG. 1 is a full-scale 1:1 photograph of a portion of a weft inserted warp knit fencing product in accordance with the present invention in which the weft yarns run horizontally and warp yarns run vertically. The knit fence product is disposed with the weft yarns running perpendicular to the installation site surface (resembling slats of a wood-type snow fence) leaving the knit and warp inserted yarns in the horizontal directions parallel to the terrain.
Figure 2:
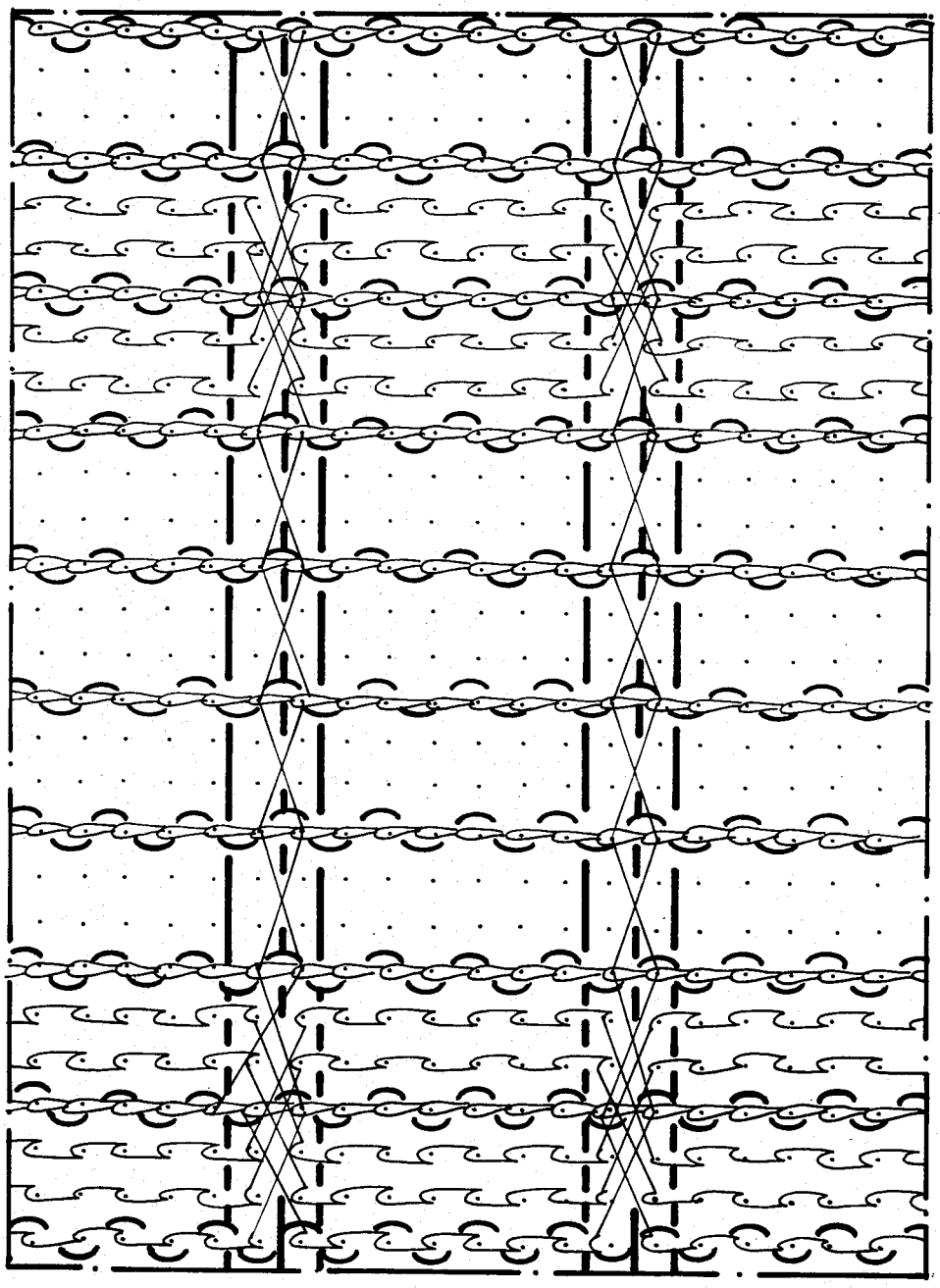
FIG. 2 is a schematic representation showing the knit design of FIG. 1 including the selvedge at both ends of the knit fabric's width.

The specific knit configuration as depicted in FIG. 2 as follows:

$$FGB = \overbrace{4 - 3/3 - 4/4}^{4x} - 3 \quad \overbrace{/1 - 0/0 - 1/3}^{4x} - 4//$$

$$MGB = \overbrace{0 - 1/1 - 0/0}^{4x} - 1 \quad \overbrace{/3 - 4/4 - 3/1}^{4x} - 0//$$

$$ST = BGB = 0 - 0/1 - 1//$$

Figure 3:
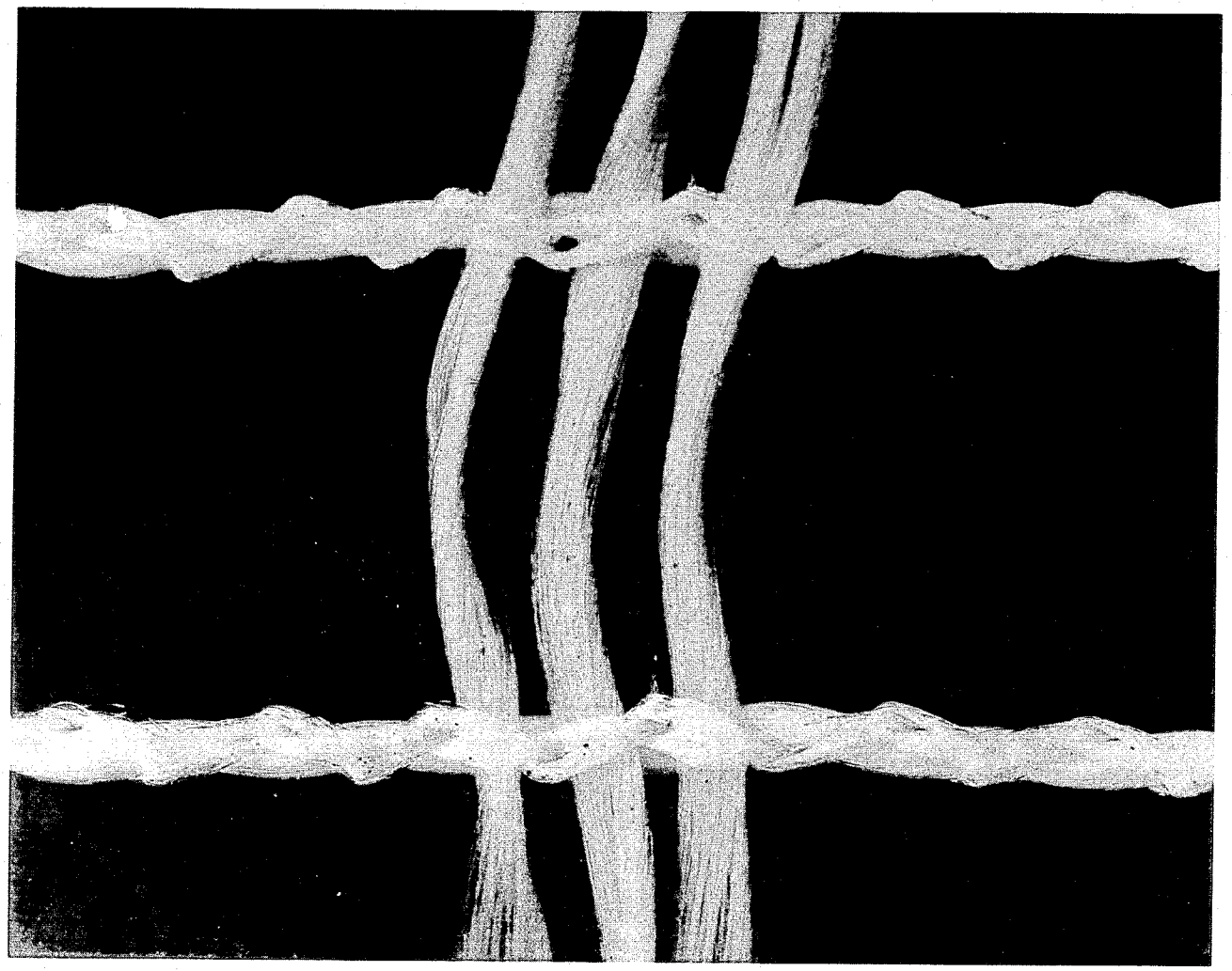
FIG. 3 is an enlarged photographic view of a portion of the top surface (overlap view, technical face) of the knit fabric construction of FIG. 1 showing in detail the knit and warp inserted yarns, running in the machine direction binding three parallel fill yarns together with a series of chain linked stitches.
Figure 4:
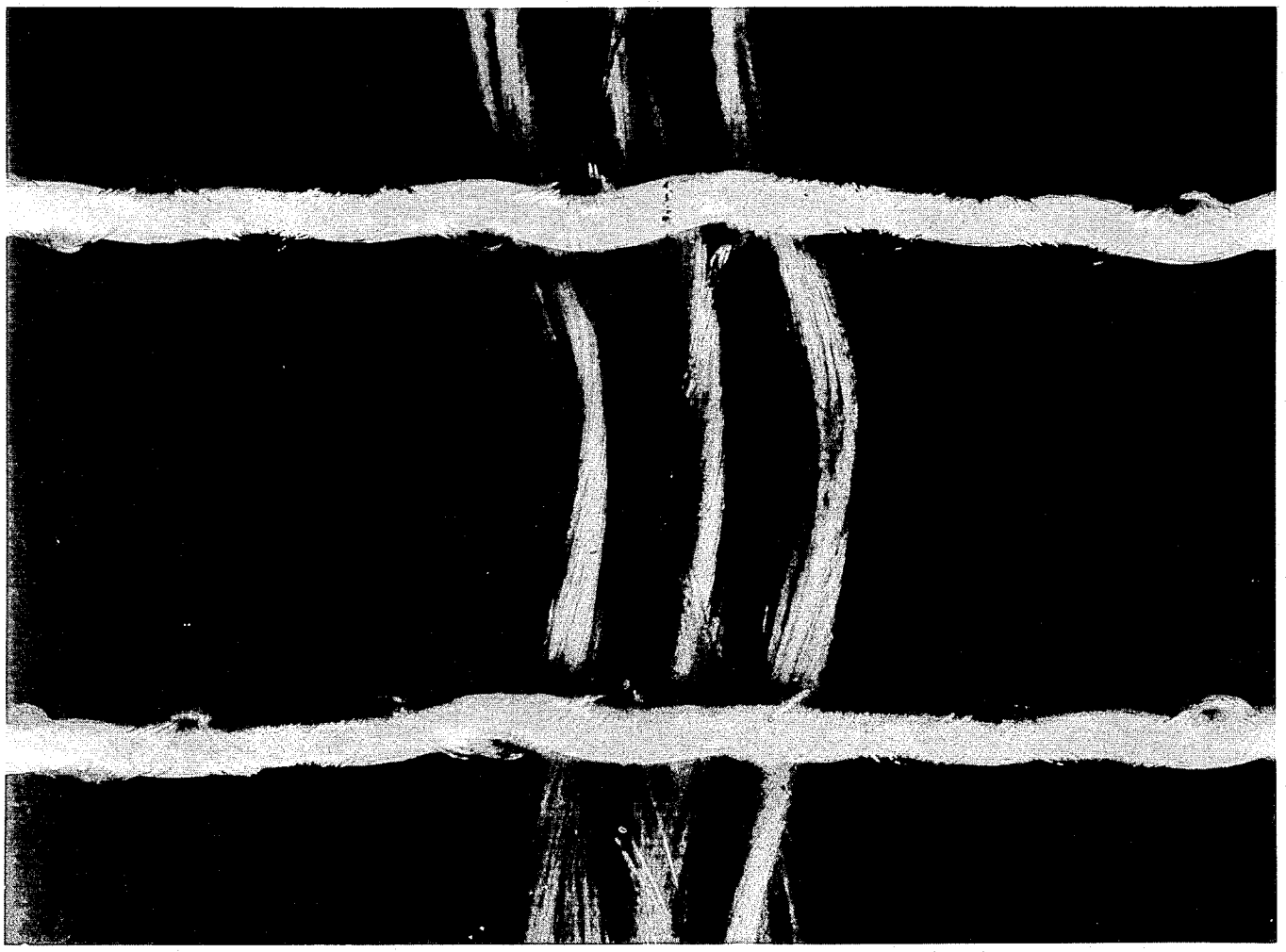
FIG. 4 is an enlarged photographic view (technical back) of the opposite side of FIG. 3 showing the knit yarns wrapped around the horizontal laid in weft yarns. This figure also shows the pair of alternating warp inserted yarns running in the vertical direction.

Referring now to the enlarged views (photographs) of the knit fabric construction of FIGS. 3 and 4 prior to application of the polymeric coating, FIG. 3 is an overlap view of the knit fabric construction showing 3 weft inserted yarns in the vertical center of the photograph held to the laid in warp yarns (shown horizontally) by a series of knitting stitches of the knitting warp yarns that surround the laid in warp and weft yarns. The warp yarns run in the machine direction. Both the knitting warp yarns and the laid in warp yarns are partially threaded to provide the desired number of openings in the fabric construction.

FIG. 4 is the underlap view—the opposite side of FIG. 3—of the knit fabric construction of this invention again with the weft inserted warp yarns in the vertical center of the photograph. The laid in warp yarns are in the horizontal direction and the backside of the knitting warp yarns, opposite the overlap side, are more clearly shown surrounding the laid in warp and weft yarns.

Both figures show a pair of cross-over knit yarns travelling diagonally between the adjacent warp yarns. These cross-over knit yarns attach each adjacent warp end and serve to stabilize the warp yarns. They move in alternate fashion to cross-over from adjacent warp ends to secure the warp yarns and minimize warp yarn slippage. The cross-over occurs as the pair of yarns is knitted to the laid in warp yarns, alternated end-for-end, then knit to the next adjacent bundle of warp yarns. From these photographs it is evident that the specific knit fabric construction may vary in virtually all parameters—distance between adjacent warp yarns, distance between adjacent groups of weft inserted yarns, number of yarns in each group of weft inserted yarns and, of course, the denier of each of these yarns. The knit pattern will vary by partial threading of the knitting warp yarns and laid in warp yarns and will be adjusted to provide the open spaces required for the knit fencing product.

Figure 5:
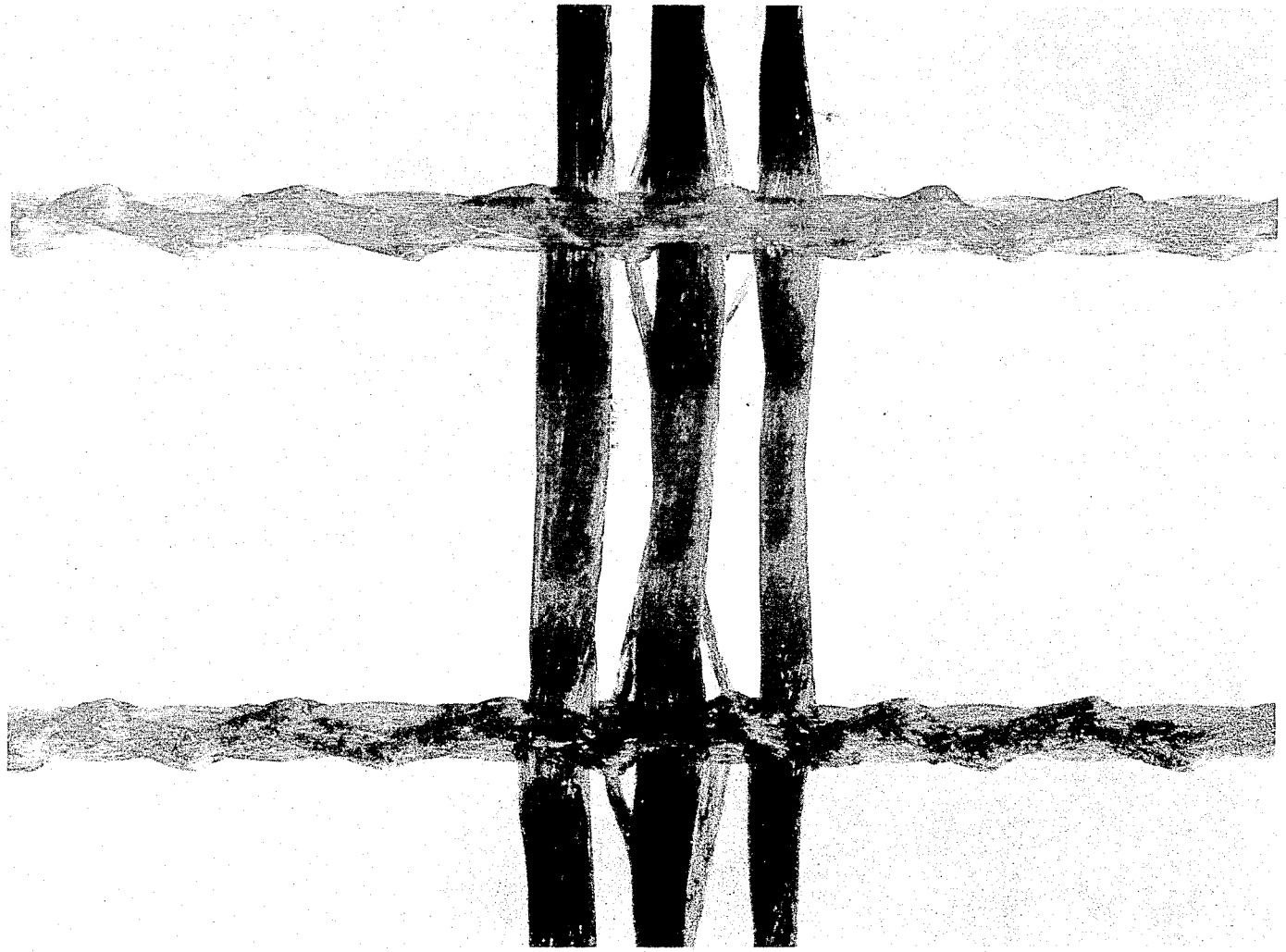
FIGS. 5 and 6 are enlarged photographic views (technical face, top technical back) of the knit fabric construction of FIGS. 3 and 4, respectively, showing the finished product with the abrasion and ultraviolet light resistant polymeric coating on it.
Figure 6:
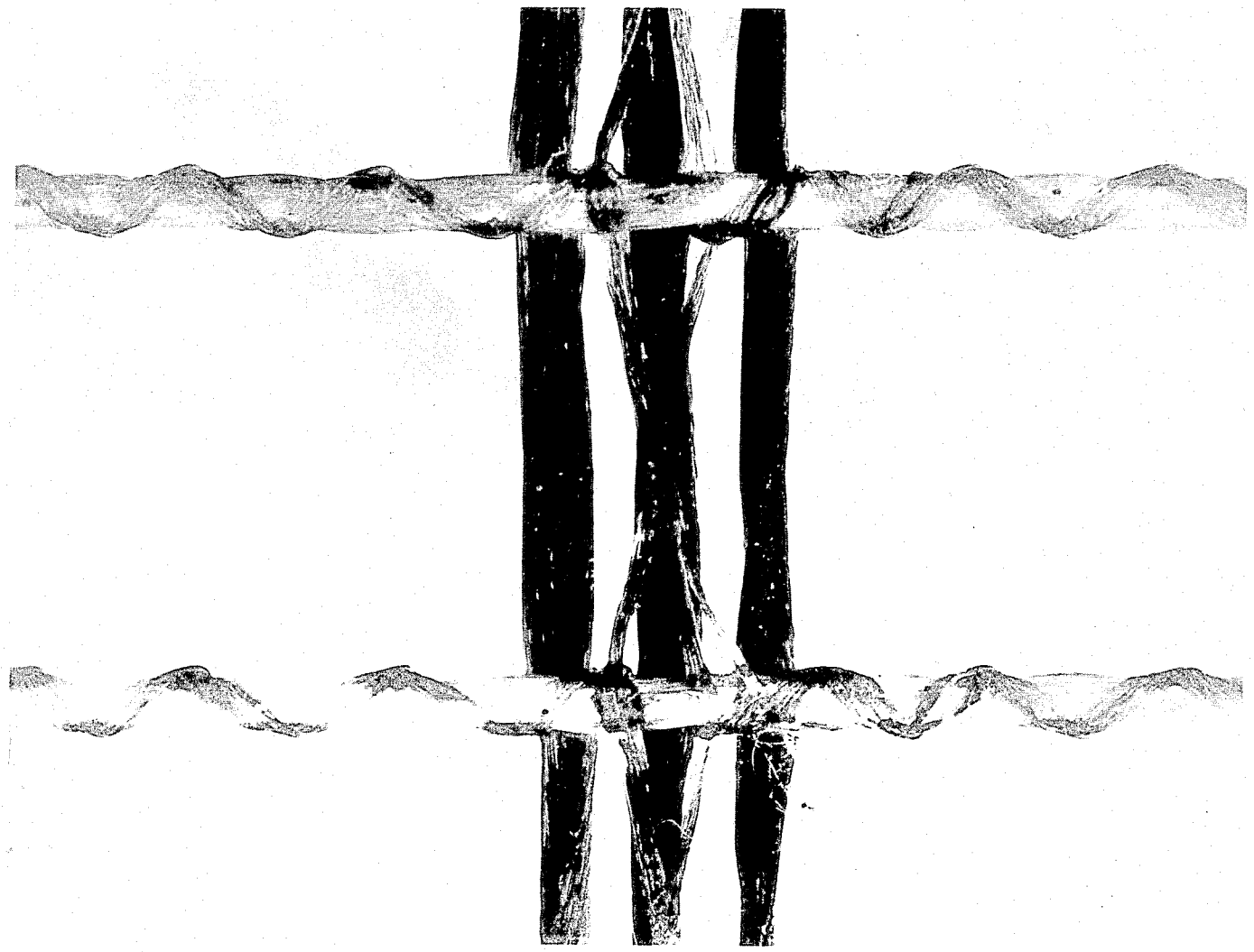

FIGS. 5 and 6 are essentially the same views as FIGS. 3 and 4, respectively, showing the knit fencing product in finished form with the abrasion and ultraviolet light resistant polymeric coating applied to the knit fabric construction described above. The applied polymeric coating serves to impregnate into each of the strands of the yarns to encapsulate and adhere the strands to each other. The polymeric coating also tends rigidity and support the otherwise flacid uncoated knit fabric construction. As shown in the photographs of FIGS. 5 and 6, the polymeric coating adheres the strands together in a tighter, more consolidated bundle. Polymeric coating thickness may vary but will not be thicker than the diameter of the yarns, otherwise the open, porous characterictics of the fabric are lost.

As described in U.S. Pat. No. 4,434,200, impregnation of the yarn bundle protects the yarn bundle from abrading itself, while placement of the compound on the surface of the yarn bundle acts as an abrasion resistant surface and an ultraviolet light screen to protect the underlying yarn bundle. This same impregnate while protecting the yarn bundle also will allow the yarn bundle to be supple yet tough above 50° F. and become increasingly firm and hard as the temperature drops below 50° F. and approaches the glass transition temperature of the impregnate.

The elastomeric composition is distributed and adhered to the outside surface of knitted fabric in a substantially even manner and in most cases will be impregnated into the fibers themselves. This impregnation aids in bonding the coating to the fibers, adhering the fibers to each other and depending on the nature of the elastomeric composition, helps to partially support and rigidify the knit product. The elastomeric coating is typically relatively thin, with respect to the strands of the knit product and, is preferably applied to have a relative thickness no greater than the diameter of each of the strands of the knitted product. The elastomeric composition renders the product capable of withstanding sustained periods of direct sunlight.

As used herein, the term elastomeric finish includes, but is not limited to, methyl, ethyl and butyl acrylate polymers, copolymers and blends thereof, butyl rubber, chlorinated butyl rubber, plasticized vinyl chloride polymers, polychloroprene (neoprene), polyurethane, and chlorosulfonated polyethylene.

Aerodynamic and abrasion resistance properties of the fencing are improved with low temperatures, yet installation of the fence at temperatures above 50° F. is facilitated by the suppleness of the fabric. The materials and procedures described in U.S. Pat. No. 4,434,200 are also suitable for the present invention; the yarns can be protected with such a polymer system applied from either a solvent or aqueous medium. The disclosure of U.S. Pat. No. 4,434,200 is hereby incorporated by reference.

In addition to this earlier procedure, we have discovered another preferred system of polymer application-/impregnating/curing that requires neither a solvent nor an aqueous medium. Carefully chosen polymers with glass transition points in the temperature ranges suggested above are utilized in this new system. This preferred coating/impregnate utilizes radiation curing in which electromagnetic radiation energy is used to effect chemical and physical changes in organic chemical materials to form crosslinked polymer networks or by molecular change. Primary radiation sources are ultraviolet curing (UVC) and electron beam curing (EBC)—which are commonly referred to as short wave lengths of light and high energy electrons.

Monomers and oligomers that can be utilized in the radiation curing system are listed below:

| Monomers | Function in Recipe |
|---|---|
| acrylate esters | crosslink-diluent |
| acrylate ethers | accelerate cure |
| methacrylate esters | abrasion resistance |
| epoxy | adhesion promoter |
| acrylamides | Cure retarder |
| vinyl monomer | abrasion resistance |
| **Oligomers** | **Function in Recipe** |
| epoxy methacrylates | polymer backbones |
| urethane methacrylates | film former |
| unsatured hydro carbons | adhesion promoter |
| polyester | hardness |
| thermoplastic polymers | elastomeric properties |

A typical formulation preferred as an impregnating finish is as follows. Removal of the photo-initiator from the recipe allows the change from UVC to EBC systems.

| | | UVC Units | EBC Units |
|---|---|---|---|
| oligoester acrylate | polymer | 56 | 56 |
| trimethylpropane theioxy triacrylate | polymer | 20 | 20 |
| methacrylic acid | adhesion promoter I | 6 | 6 |
| hydroxylethyl methacylate | adhesion promoter II | 2 | 2 |
| benzophenone | photo initiator | 4 | — |
| hindered amine | light stabilizer | 2 | 2 |
| pigment | color | 10 | 10 |
| ZnO | UV inhibitor | — | 4 |

This finish is impregnated to a level of at least 50% of the fabric weight and not more than 150% of the fabric weight.

The polymeric protective coating composition, through formula variation, in addition to improving the resistance to ultraviolet light in oxygen degradation, may be used as a base for printing directions or advertisements directly on the finished fencing product. Such imprinting may include, for example, logos, medallions, emblems, warnings or other desirable indicia. It has been found through suitable pigmentation that, together with other screening ingredients, the sunfastness of the acrylic polymers of elastomeric polymers employed in enhanced and reinforced. While it is also possible to use "Dope-dyed" or solution-dyed fabrics such as nylon or polyester during weaving in order to achieve a colored ultimate product, it will be appreciated that the preferred method of producing a colored product is to incorporate one or more pigments in the elastomeric finishing composition as previously described. A combination of both dyed yarn and pigmented finishing compositions can also be used.

What is claimed:

1. A weather-resistant knitted fabric constructions knitted in a predetermined width from yarns of a tough, elastic, synthetic polymeric material into an open pattern in which from about 40% to about 80% of this product surface is open to the passage of air and particles there through, the closed portion of the pattern providing resistance to the passage of air and particulants there through and causing particulates to deposit and accumulate in the area adjacent the fencing product, the product consisting essentially of:

a plurality of laid in warp yarns disposed in the machine direction and spaced apart from each other.

a plurality of weft inserted yarns arranged in bundles of at least two and disposed perpendicular to the machine direction, each bundle of weft inserted yarns spaced apart from the adjacent bundle of bundles, a pair of knitting warp yarns for each laid in warp yarn, the knitting warp yarns knitted in the machine direction around the underlying laid in warp and weft yarns, the knitting warp yarns securing the weft inserted yarns to the laid in warp yarns.

the fabric construction having a relatively thin elastomeric, weather-resistant coating substantially evenly adhered to the surface of and impregnated into each of said strands thereby encapsulating and adhering said strands to each other to rigidify and support the knit product, and to render the product capable of withstanding sustained periods of direct sunlight, the relative thickness of said coating being not greater than the diameter of each of the yarns.

2. A weather-resistant knitted fabric construction as claimed in claim 1 in which there are three weft inserted yarns per bundle.

3. A weather-resistant knitted fabric construction as claimed in claim 1 having a band of selvedge perpendicular to the machine direction at each end of the knitted fabric, the selfedge adapted to secure and mount the knitted fabric.

4. A weather-resistant knitted fabric construction as claimed in claim 1 in which the weather-resistant elastomeric coating is selected from the group consisting of thermoset and thermoplastic polymers.

5. A weather-resistant knitted fabric construction as claimed in claim 1 in which the elastomeric coating is selected from the group consisting of acrylate polymers, acrylate copolymers, butyl rubber, chlorinated butyl rubber, plasticized vinyl chloride polymers, polychloroprene, polyurethane, and chlorosulfonated polyethylene.

6. A weather-resistant knitted fabric construction as claimed in claim 1 in which the yarns are formed of a tough, elastic, synthetic plastic material.

7. A weather-resistant knitted fabric construction as claimed in claim 6 in which the plastic material is selected from the group consisting of acrylic polymers, polypropylene, nylon and polyesters.

* * * * *